United States Patent [19]

Heydrich et al.

[11] 4,344,390

[45] Aug. 17, 1982

[54] PISTON-CYLINDER ASSEMBLY OF AN INTERNAL COMBUSTION ENGINE

[75] Inventors: Hans Heydrich, Phoenix, Ariz.; Melvin E. Woods, Columbus, Ind.; William C. Geary, Balston Lake, N.Y.

[73] Assignee: Cummins Engine Company, Inc., Columbus, Ind.

[21] Appl. No.: 108,833

[22] Filed: Dec. 31, 1979

[51] Int. Cl.[3] ..... F02B 75/08

[52] U.S. Cl. ..... 123/41.82 A; 123/193 CH; 123/669

[58] Field of Search ..... 123/193 R, 193 C, 193 H, 123/193 CH, 668, 669, 657

[56] References Cited

U.S. PATENT DOCUMENTS

| | | | |
|---|---|---|---|
| 3,081,754 | 3/1963 | Georges | 123/668 |
| 3,115,127 | 12/1963 | Spencer et al. | 123/41.82 |
| 3,125,082 | 3/1964 | Stansfield et al. | 123/41.82 |
| 3,459,167 | 8/1969 | Briggs et al. | 123/669 |
| 4,074,671 | 2/1978 | Pennila | 123/668 |

*Primary Examiner*—Craig R. Feinberg

*Attorney, Agent, or Firm*—Neuman, Williams, Anderson & Olson

[57] ABSTRACT

A piston-cylinder assembly of an internal combustion engine is provided which includes a cylinder liner mounted within a bore formed in an engine block, and a cylindrical spacer extending axially and endwise from the liner and coacting therewith to form a cylinder in which a piston is mounted for reciprocatory movement. An end piece overlies an end of the spacer and is supported by the latter. The end piece substantially closes off one end of the cylinder and the piston is in close proximity thereto when at one stroke limit. When the piston is at the one stroke limit, it coacts with the end piece and the spacer to define a combustion chamber. The end piece is secured in assembled relation with the spacer by a first means. A second means is provided for effecting substantial thermal insulating of the block, liner and first means from the heat of combustion which is generated in the combustion chamber during operation of the engine.

14 Claims, 4 Drawing Figures

FIG. 1
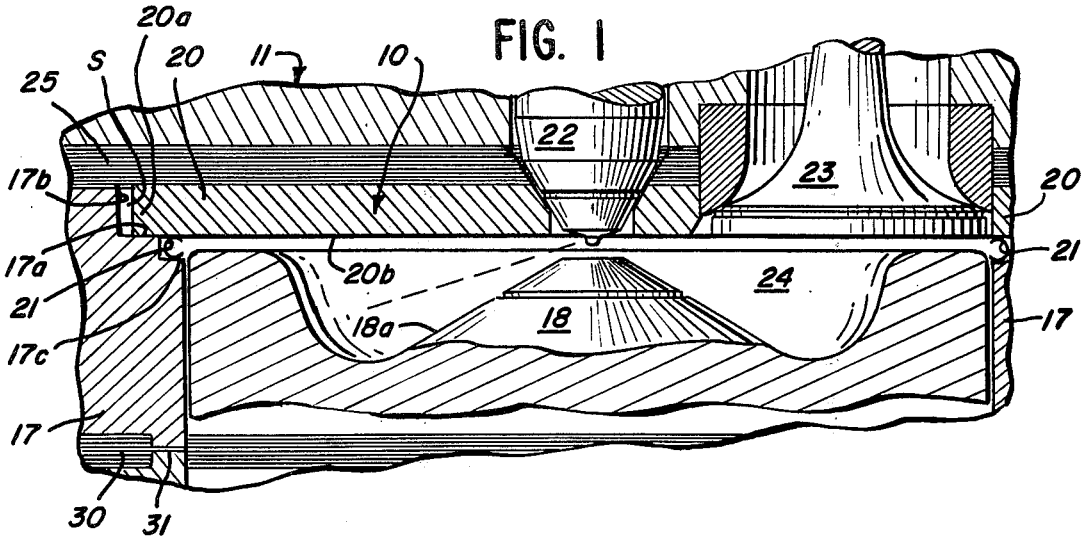
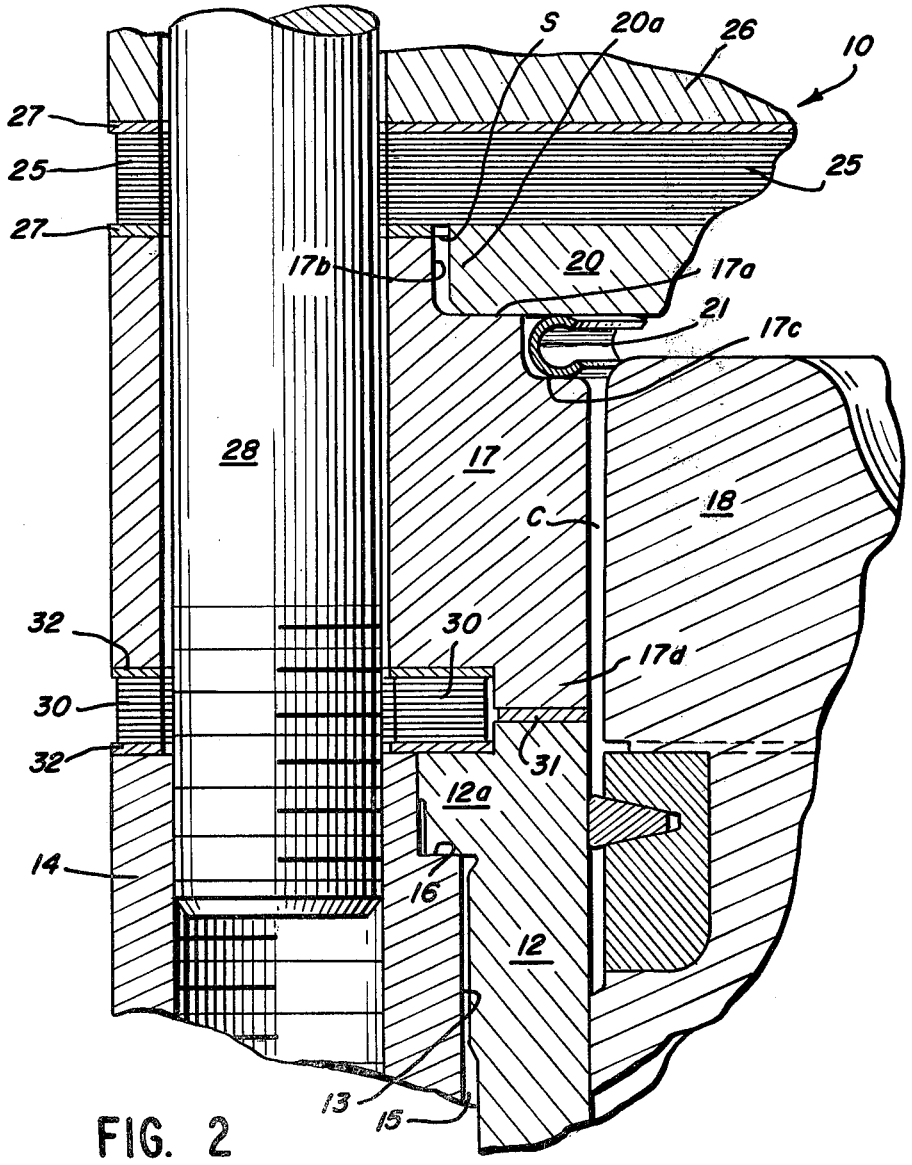
FIG. 2

FIG. 3
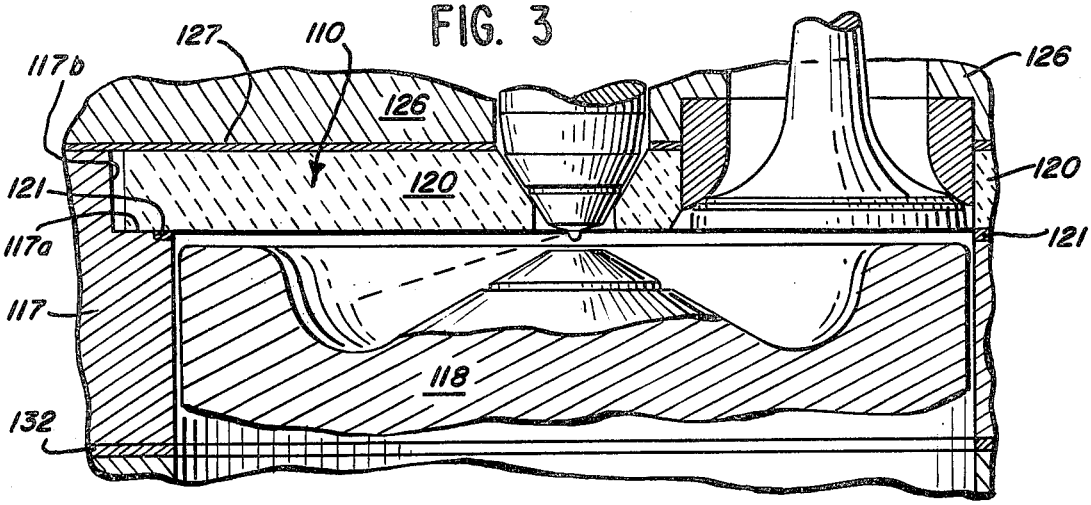
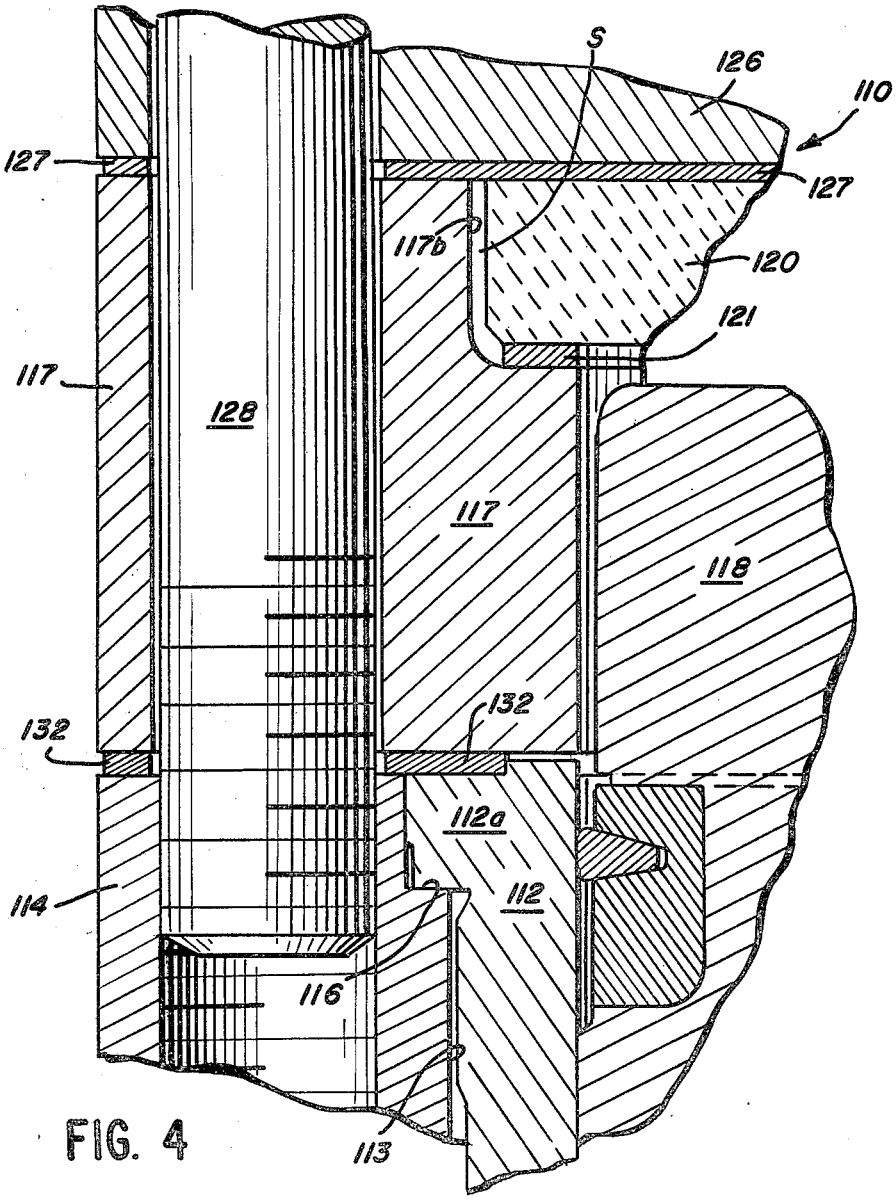
FIG. 4

PISTON-CYLINDER ASSEMBLY OF AN INTERNAL COMBUSTION ENGINE

The United States Government has rights in this invention pursuant to Contract No. DAAK 30-77-C-0032 awarded by the U.S. Defense Department.

BACKGROUND OF THE INVENTION

Heretofore various internal combustion piston-type engines have been provided which, however, because of inherent design characteristics are beset with one or more of the following shortcomings: (a) the heat of combustion causes inordinate thermal loads to be imposed on the engine cooling system; (b) the thermodynamic efficiency of the cylinder is poor; (c) a substantial amount of energy produced by the combustion gases is wasted; and (d) excessive wear of the cylinder liner, piston rings and seals occurs due to the inordinately high temperature to which they are subjected during operation of the engine.

SUMMARY OF THE INVENTION

Thus, it is an object of the invention to provide a piston-type engine which readily avoids the aforenoted problems associated with prior engines of this general type.

It is a further object of the invention to provide a piston-type engine wherein heat flow from the combustion chamber of each engine cylinder is significantly reduced without requiring extensive modifications to be made to various components of the engine.

It is a still further object of the invention to provide an improved piston-cylinder assembly which may be incorporated in piston-type engines varying over a wide range in size and operating demands.

Further and additional objects will appear from the description, accompanying drawings, and appended claims.

In accordance with one embodiment of the invention, a piston-cylinder assembly of an internal combustion engine is provided which includes a cylinder liner mounted within a bore formed in an engine block. Disposed at one end of the liner and extending axially therefrom is a cylindrical spacer. The spacer coacts with the liner to form a cylinder in which is mounted a reciprocating piston. Overlying the end of the spacer is an end piece which substantially closes off the cylinder end. The end piece, the spacer, and the piston, when the latter is at one stroke limit, coact to form a combustion chamber. The end piece is secured in assembled relation with the spacer by a first means. A second means effects substantial thermal insulating of the block, the liner and the first means from the heat of combustion which is generated within the combustion chamber during operation of the engine.

DESCRIPTION

For a more complete understanding of the invention reference should be made to the drawings wherein:

FIG. 1 is a fragmentary sectional view of one form of the improved piston-cylinder assembly of a diesel engine; the section plane including the axis of the cylinder and showing the piston at one stroke limit.

FIG. 2 is an enlarged fragmentary sectional view of the left-hand portion of FIG. 1.

FIG. 3 is similar to FIG. 1 but showing a second form of the improved piston-cylinder assembly.

FIG. 4 is an enlarged fragmentary sectional view of the left-hand portion of FIG. 3.

Referring now to the drawings and more particularly to FIGS. 1 and 2, one form of the improved piston-cylinder assembly 10 is shown incorporated in an internal combustion (diesel) engine 11. The assembly 10, as illustrated, includes a conventional metal (iron) cylinder liner 12 which is disposed within a suitable bore 13 formed in the block 14 of the engine 11. The number and relative location of the bores formed in the block will depend upon the size and desired operating characteristics of the engine. The exterior of the liner 12 is cooled by the spacing or air gap 15 provided between the bore and liner, see FIG. 2. In some instances the liner may be left uncooled. The liner is of conventional design and the upper end thereof is delimited by an external collar **12*a* which fits within a ledge 16 formed in the block 14 by countersinking the upper end of bore 13**.

Disposed in axially aligned relation and extending endwise from the collared end of the liner 12 is a cylindrical spacer 17 of a heat and oxidation resisting steel alloy material. The interior surfaces of the liner 12 and spacer 17 coact to form a cylinder C in which is mounted a piston 18.

Overlying the end of cylinder C is an end piece 20 sometimes referred to as hot plate. The end piece is preferably formed of a heat resistant alloy (e.g., nickel base alloy); however, in some instances it may be formed of a ceramic (e.g., hot pressed silicon nitride). The outer periphery **20*a* of the piece 20 is supported by a ledge 17*a* formed in the upper end of spacer 17. It will be noted in FIGS. 1 and 2 that a substantial clearance space S is provided between the periphery of the end piece and a recessed wall 17*b*** formed by the ledge so as to compensate for any thermal expansion of the end piece which occurs relative to the spacer during operation of the engine.

Disposed radially inwardly from the ledge **17*a* is a second ledge 17*c* formed in the upper end of spacer 17. Disposed on the second ledge 17*c* is a self-actuating metallic ring seal 21. The seal may be formed of a high temperature alloy material (e.g., ×750 nickel base alloy). The seal in cross section may have a C-shaped configuration with the open side thereof facing the cylinder in which the piston 18 moves. Thus, the pressure of the combustion gases during operation of the engine will increase the sealing capabilities of the seal 21**. Other self-acting seal configurations, such as a "K" shape, or non-self-acting seals like gas pressurized metallic "O" rings, can be utilized.

As will be observed in FIG. 1, the end piece 20 is provided with suitable openings to accommodate a fuel injector 22 and a plurality of valves 23, only one being shown in FIG. 1. The fuel injector and valves are of conventional design. The end piece 20 of assembly 10 is capable of withstanding the high combustion temperatures (e.g., 1700° F. av.) and pressures without deformation. Thus, during operation of the engine, the temperature of the end piece will remain very high, thereby effecting more efficient and complete combustion of the volatile gases entrapped within the combustion chamber 24. The combustion chamber 24 is formed by the coaction of the end piece surface **20*b*, the interior cylindrical surface of the spacer 17, and the upper surface 18*a* of the piston 18 when the latter is disposed at one stroke limit. As is customary, the piston surface 18*a*** is contoured so as to effect proper intermixing and distribution of the injected fuel with the entering gases.

To prevent dissipation of the heat from the end piece 20 (when formed of metal) to adjacent engine components, there is provided a plurality of thin, thermal barrier shims 25 which are arranged in stacked superposed relation and positioned in overlying relation with respect to the end piece. The individual shims may be formed of a heat resistant steel material which has a roughened surface texture or they may be formed of a similar material which is plasma coated with an insulated ceramic (e.g., Zirconia). The thickness of each shim in either material is in the range of 0.002 to 0.012 inches. Heat transfer considerations favor shims as thin as possible; but, manufacturing and handling considerations dictate the lowest practical limit on the shim thickness. In either instance, the shims provide an effective thermal barrier for a cylinder head 26 positioned thereabove and in substantially superposed relation therewith. As seen in FIG. 2, both the shims 25 and head 26 project laterally a substantial distance beyond the periphery of end piece 20 and thus the outer peripheral portions of the shims are sandwiched between the spacer 17 and the head 26. If desired, a compliant seal 27 may be positioned at the top and bottom of the stack of shims so as to prevent leakage of the combustion gases. The compliant seal may be a thin section of low carbon steel coated on both sides with a graphite material such as GRAFOIL (T.M., Union Carbide Corp.) and having an overall thickness of approximately 0.054 inches.

Suitable fasteners 28 (anchor bolts) may be utilized which are threaded into the engine block 14 and serve to retain the head 26, shims 25, end piece 20, and spacer 17 in proper assembled relation. Suitable openings in the head 26 and shims 25 may be provided through which the anchor bolts extend.

The underside of spacer 17 may be insulated from the engine block 14 by a second stack of insulating shims 30 which are similar in composition to shims 25. In the embodiment shown in FIGS. 1 and 2, the shims 30 do not extend inwardly to the cylinder C but are spaced outwardly therefrom. A portion **17*d* of the spacer is interposed the shims 30 and the cylinder C. The underside of spacer portion 17*d* is spaced above the adjacent top surface of the liner 12, thereby providing discontinuity between the spacer portion and the liner. If desired, however, a compliant seal 31 can be interposed the spacer portion 17*d* and the adjacent liner surface. In addition, a compliant seal 32 may be positioned at the top and bottom surfaces of the second stack of shims 30. The compliant seals 31, 32 may be of the same construction as seals 27**.

FIGS. 3 and 4 illustrate a second form of piston-cylinder assembly 110. Components of assembly 110 which are similar to those of assembly 10 will be identified by the same number but in a 100 series. The principal differences between assembly 10 and assembly 110 reside in the composition of certain of the components. In assembly 110, the spacer 117 is a monolithic piece of ceramic material (e.g., sintered silicon nitride). The end piece 120 may also be of a monolithic piece of the same ceramic material. Furthermore, in lieu of the stacks of shims 25, 30, the head 126 is separated from end piece 120 by a compliant seal 127, and the lower end of the spacer 117 is separated from the adjacent upper surfaces of block 114 and liner 112 by a compliant seal 132. A compliant seal 121 may also be substituted for the self-actuating seal 21 of assembly 10. All of the compliant seals 121, 127 and 132 may be of the same composition as those of assembly 10.

In both assemblies, the end piece 20 in combination with thermal barrier shims 27, or the end piece 120 alone, provides a shield for the upper portions of the engines (e.g., head 26, 126) against the high temperatures (e.g., approximately 1700° F.) of the combustion gases; and further provides a hot surface at the top of the combustion chamber resulting in more complete combustion of the volatile gases within the chamber. The spacer 17, 117 in both instances, also provides an elevated surface temperature at the upper end of the cylinder. The discontinuity between the lower end of the spacer 17, 117 and the upper end of the liner 12, 112 limits the heat flow from the spacer to the liner, thereby reducing significantly the heat load on the liner cooling system. The thermal barrier shims 27, 30 or the ceramic spacer 117 and end piece 120 reduce substantially the heat transfer from the combustion chamber into the head and engine block. In view of the foregoing conditions, which exist in the improved piston-cylinder assemblies 10, 110, there results in each instance (a) reduced thermal loads on the engine cooling system; (b) increased thermodynamic efficiency in the cylinder; (c) higher internal energy in the combustion gases; (d) improved combustion characteristics due to the hot surfaces of the end piece and spacer; and (e) reduced heat input to lower portion of the cylinder liner which is traversed by the piston rings during engine operation.

It is to be recognized that the size and shape of the various components of the engine and its piston-cylinder assembly may be varied from those illustrated and disclosed without departing from the scope of the claimed invention.

We claim:

1. A piston-cylinder assembly of an internal combustion engine comprising an engine block having a bore formed therein; a cylinder liner having an inner diameter mounted within said bore; a cylindrical spacer having one end disposed in closely spaced relation to an end of said liner, said spacer having a cylinder-forming surface comprising an inner bore extending therethrough and having an inner diameter substantially equal to the inner diameter of said liner, said spacer extending axially from said liner end and coacting with said liner to form together an elongated cylinder; a piston mounted for reciprocatory movement within the elongated cylinder; an end piece overlying and being supported by a recessed shoulder within a second end of said spacer opposite said liner end, said end piece coacting with said spacer to substantially close one end of the elongated cylinder, so as to create a top cylinder-forming surface, said piston when at one stroke limit being in close proximity to a surface of said end piece adjacent said cylinder and coacting therewith and the cylinder-forming surface of said spacer to define a combustion chamber axially spaced from said liner end whereby the latter is substantially shielded by said spacer from the heat and pressure of combustion generated within said combustion chamber during operation of the engine; first means spaced from said combustion chamber for securing said end piece in assembled relation with said spacer; and thermal insulating second means coacting with said end piece, said first means, said spacer ends and said liner end to substantially impede the transfer of the heat of combustion from said combustion chamber to said block, liner and first means during operation of the engine.

2. The piston-cylinder assembly of claim 1 wherein the cylinder-forming surface of said spacer is at a substantially greater temperature than that of said liner during operation of the engine.

3. The piston-cylinder assembly of claim 1 wherein the second end of the spacer containing said shoulder is provided with an interior ledge recessed from and encompassing the combustion chamber and supportingly accommodating peripheral portions of said end piece; said ledge being sized relative to the end piece periphery to compensate for thermal expansion and contraction of said end piece.

4. The piston-cylinder assembly of claim 3 wherein a combustion gas seal is interposed said end piece and a portion of said ledge subtending said end piece and includes a resilient annular metallic hollow element.

5. The piston-cylinder assembly of claim 1 wherein each of the thermal insulating second means includes a plurality of shims arranged in stacked superposed relation.

6. The piston-cylinder assembly of claim 5 wherein peripheral portions of said stacked shims extend laterally beyond said end piece and are interposed said head member and said spacer.

7. The piston-cylinder assembly of claim 1 wherein the first means includes a head member removably secured to said block and overlying said end piece, said head member being spaced from said end piece by a portion of said second means.

8. The piston-cylinder assembly of claim 7 wherein the combustion chamber-forming surfaces of said end piece and said spacer form heat barriers to the combustion gases generated during operation of the engine; said end piece being separated from said head member by a first compliant combustion gas seal, and the one end of said spacer being separated from said liner end by a second compliant combustion gas seal.

9. The piston-cylinder assembly of claim 8 wherein the head member and the spacer are separated from one another by a portion of said first compliant seal.

10. The piston-cylinder assembly of claim 9 wherein the spacer and the block are separated from one another by a portion of said second compliant seal.

11. The piston-cylinder assembly of claim 1 wherein portions of said second means and the combustion chamber-forming surfaces of said end piece and said spacer effect substantial confinement of the gases of combustion generated within said chamber during operation of the engine.

12. The piston-cylinder of claim 11 wherein said end piece surface and said spacer surface form a heat barrier for said first means.

13. The piston-cylinder assembly of claim 11 wherein the combustion chamber-forming surface of said end piece is of a ceramic material forming a heat barrier.

14. The piston-cylinder assembly of claim 11 wherein the combustion chamber-forming surface of said spacer is of a ceramic material forming a heat barrier.

* * * * *

UNITED STATES PATENT AND TRADEMARK OFFICE

CERTIFICATE OF CORRECTION

PATENT NO. : 4,344,390

DATED : August 17, 1982

INVENTOR(S) : Hans Heydrich, Melvin E. Woods, and William C. Geary

It is certified that error appears in the above-identified patent and that said Letters Patent are hereby corrected as shown below:

Column 4, after line 34 - Portion left out should be
-- The United States Government has rights in this invention pursuant to Contract No. DAAK 30-77-C-0032 awarded by the U.S. Defense Department. --

Signed and Sealed this

*Twenty-eighth* Day of *December 1982*

[SEAL]

*Attest:*

GERALD J. MOSSINGHOFF

*Attesting Officer*

*Commissioner of Patents and Trademarks*